United States Patent [19]

Waehner et al.

[11] Patent Number: 4,722,814

[45] Date of Patent: Feb. 2, 1988

[54] PROPELLENT CHARGE AND METHOD OF MAKING THE CHARGE BY CRUSHING PARTS WITH HOLES

[75] Inventors: Gero Waehner, Schramberg-Waldmoessingen; Michael Korn, Oberndorf-Bochingen; Dieter Fichter, Obendorf; Heinrich Brachert, Daisendorf; Dieter Girke, Troisdorf, all of Fed. Rep. of Germany; Johan Kobes, Amstelveen, Netherlands

[73] Assignee: Mauser-Werke Oberndorf GmbH, Fed. Rep. of Germany

[21] Appl. No.: 466,367

[22] Filed: Feb. 14, 1983

[30] Foreign Application Priority Data

Feb. 13, 1982 [DE] Fed. Rep. of Germany ..... 3205152

[51] Int. Cl.[4] ..... C06B 21/00

[52] U.S. Cl. ..... 264/3.4; 86/20 R; 149/2; 102/292

[58] Field of Search ..... 264/3 R, 3.1; 149/2; 86/20 R; 102/285, 287, 292, 430

[56] References Cited

U.S. PATENT DOCUMENTS

| | | | |
|---|---|---|---|
| Re. 30,002 | 5/1979 | Dooley et al. | 102/430 |
| 3,032,970 | 5/1962 | Fox | 102/347 X |
| 3,928,514 | 12/1975 | Brachert et al. | 264/3 R X |
| 3,937,770 | 2/1976 | Wiedemann et al. | 264/3 C |
| 3,968,724 | 7/1976 | Kowalick et al. | 102/324 X |
| 4,100,000 | 7/1978 | Sterling et al. | 264/3 C |

FOREIGN PATENT DOCUMENTS

| | | | |
|---|---|---|---|
| 2457748 | 10/1976 | Fed. Rep. of Germany | 264/3 C |

*Primary Examiner*—Peter A. Nelson

*Attorney, Agent, or Firm*—McGlew and Tuttle

[57] ABSTRACT

A propellent charge for cartridge ammunition of propellent powder bodies of a certain geometric form is produced by filling the propellent powder bodies preferably in partial amounts and by means of a suitable funnel into the propellent case and compressing them there without the addition of binders and/or solvents up to a charge density 1.0 to 1.5 g/cc, and that they are shaped elastically to plasticity under substantially uniform and/or gradually varying compression.

12 Claims, 4 Drawing Figures

PROPELLENT CHARGE AND METHOD OF MAKING THE CHARGE BY CRUSHING PARTS WITH HOLES

FIELD AND BACKGROUND OF THE INVENTION

The invention relates in general to the construction of a propellent charge and in particular to a new and useful propellent charge for cartridge ammunition of propellent powder bodies of a certain geometric form, which are filled into propellent cartridge cases, particularly multi-hole, tubular-, strip- and spherical powder cases, and a process for the production of these propellents.

When firing a shot in a barrel gun, the gas generated by the combustion of a solid propellent powder imparts to the projectile translatory and rotational energy.

The conversion of this solid propellent into gaseous products must not be too fast, however, so that the maximum gas pressure or gas pressure increase, and the resulting load values for the projectile and the gun barrel remain low.

The individual propellent powder bodies of a propellent charge burn off in layers perpendicularly to their surface, so that the originally geometric form is substantially preserved in its basic tendency. This melting rate progressing perpendicularly to the propelled powder surface depends on the combustion pressure. The mass gradient in time of the reaction corresponds again to the product of the respective melting rate, propellent surface and propellent density.

Known propellent charges use therefore propellent powders with a progressive melting characteristic, that is, in the course of the melting, the initial melting surface increases up to a maximum value close to the combustion cutoff. If the progressivity of a propellent charge related to the safe charge density and the same maximum gas pressure which can be derived by interior ballistic considerations, must become smaller in the cartridge. A reduction of the initial melting surface required by the powder progressivity of the propellent powder body, means normally a reduction of the propellent powder mass. But in order to utilize the charge reserve obtained by an increase in progressivity in order to increase the performance, it is customary in practice to treat the surface of the propellent powder subsequently with plasticizers, particularly with centralites, phthalates or comphor. These agents have a negative formation enthalpy and reduce the entire energy of the charge mass. Because of the impregnating effect of these agents, the melting rate also diminishes in such a way that the greatest relative rate reduction occurs at the highest concentration of the agent in the propellent powder grain, hence practically on the surface. This is equivalent to a reduction on the melting surface, because the gradient of the gas mass in time corresponds to the product of the melting surface by burning rate and density.

Since the initial value for the product of burning rate by melting surface must remain constant, because of the relation between progressivity and maximum gas pressure, the propellent charge mass can be increased more, the more vigorous and differentiated the surface treatment was without increasing the maximum pressure value.

Such an adaptation of the propellent charge effects a considerable gain in progressivity of the propellent charge and an increase of the product burning rate by melting surface, compared to the increase of the propellent charge mass in the untreated propellent charge powder. But this takes place only when the phlegmatization is no longer effective. The above-described gain in progressivity leads to a considerable widening of the pressure/time curve for the powder, and thus to a considerable performance gain.

The limits for these measures lie, on the one hand, in the limitation of the maximum possible propellent charge itself, and on the other hand, in that propellent powders which have been subjected to a vigorous surface treatment are more difficult to ignite. This is a disadvantage in view of the total firing time. Besides, the energy balance of the propellent charge would deteriorate to such an extent, starting from a certain strength of the treatment that this energetic performance loss could no longer be compensated by the interior ballistic advantages.

Usually a loose propellent charge is used in cartridge ammunition, which is generally produced in granulated form as tubes, strips, spherules or multi-hole cylinders. The charge density is then about 0.9 to 1.0 g/cc, in individual high-grade propellent charge powders at best 1.05 g/cc. This yields, with a given case volume over the resulting maximum propellent charge mass in an optimum propellent charge which is determined in its formula, geometry and surface treatment by the weapon and ammunition parameters. An improvement of the performance of such an optimized loose powder charge is not possible without changing the parameter values, e.g. by increasing the maximum gas pressure or extending the path of the projectile base.

For years methods have therefore been developed to achieve an increase in performance over so-called solidified or compressed propellent charges, that is, an increase in the charge density. All these methods, however, require solvents or binders, so that the energy expenditure is considerably increased; such propellent charges are therefore very time-intensive to produce, and are also very expensive.

A process for the production of solidified powder charges is known from German OS No. 24 03 417. There the solidified powder charge consists of compressed granules of smokeless powder with a plurality of interstices, which are distributed substantially evenly over the entire compressed mass. It is essential that the surfaces of the individual granules are first softened in the production of this solidified power charge exposing them to solvent vapors, and are then compressed. Apart from the increased energy and machinery costs, such a method has the disadvantages that it requires elaborate measures to protect the health of the people.

SUMMARY OF THE INVENTION

The invention provides a propellent charge for cartridge ammunition and a process for its production by which the efficiency is increased, compared to the known propellent charges, without increasing energy expenditure and jeopardizing the health of people due to solvent vapors.

According to the invention propellent powder bodies in the propellent case are compressed by the application of external pressure without the addition of binders and/or solvents up to a charge density of 1.0 to 1.5 g/cc and are shaped elastically to plasticity by practically uniform or gradually varying compression.

An increase of the charge density by the application of external pressure could not be achieved so far because the powder bodies broke under the application of pressure, due to their brittleness, and the desired melting characteristic was therefore no longer ensured.

Elastic powder bodies are known in themselves. They are elastic due to the addition of plastisizers to the nitrocellulose prior to their shaping. The degree of elasticity depends to a great extent on the type and amount of the plasticizer used. The elasticity can also be influenced by the subsequent surface treatment with these plasticizers.

The plasticizers in these known propellent powder bodies are likewise known plasticizers for nitrocellulose, such as camphor and phthalic ester. They can be contained in the nitrocellulose alone or in mixture before they are subjected to shaping.

The pressure to be applied in the production of the propellent charge compressed according to the invention depends both on the charge density, which greatly influences the melting characteristic of the total charge, and on the elasticity of the powder bodies. Before using the process of the invention it must therefore be determined in charge determination firings what limiting charge density and thus what pressure maximum is possible without obtaining both unburnt powder residues and thus performance losses and mechanically destroyed powder bodies and thus pressure cracks over an increased surface. If necessary, powder bodies with a higher plasticizer content must be used. The main ingredient of the propellent charge bodies is nitrocellulose. In the powder bodies used according to the invention, the maximum portion is 85 to 90% weight, depending on the type of plasticizers used and on the portion of these plasticizers in the powder bodies.

In a further development of the invention the propellent charge can include partial amounts which are compressed in sections uniformly or gradually varying in the propellent charge case with the same or varying pressures. When filling with partial amounts and uniform pressure in sections, it is possible to obtain a practically constant charge density over the entire filling. But if the partial amounts are compressed with different pressures, non-homogeneities will be produced deliberately in the charge density. Furthermore, the compression can be so effected that the charge density decreases practically continually from the base to the orifice of the case. The partial amounts can furthermore be different in their formula and/or geometry.

But the propellent charge bodies must have at least in a partial amount certain geometric forms, like multihole cylinders or tubes. Due to the process of the invention, the geometric form of these bodies is so changed that the inside width of the inner channels is reduced. This is tantamount to a reduction of the melting surface, so that the charging mass can be increased within certain limits due to the above-outlined relations, without increasing the maximum gas pressure with a corresponding adaptation of the geometry or surface treatment of the propellent powder.

If the pressure-sensitive priming element is already arranged in the base of the propellent case, it can be protected in a further development of the invention by means of a mandrel inserted during the filling of the propellent power body and the channel formed by the mandrel centrally in the propellent case can be filled with a priming mixture and/or with propellent powder bodies. If necessary, this filling can again be followed by compression.

With less compression of the powder bodies and/or a technically less favorable shape of the case it may be necessary to stabilize the free pressed rim and/or charge surface against crumbling or individual powder bodies and/or warping of the compressed level until the central channel produced by the mandrel is filled, or the cartridge completed. For this reason the covering can be pressed on the propellent charge from a plastic flexible material burning without leaving a residue, preferably of Swedish additive material.

The process for the production of the propellent charge according to the invention is characterized in that the propellent powder bodies are filled directly into the propellent case by means of a funnel whose filling tube bears directly on the inner wall of the orifice of the propellent case, and are compressed by the application of external pressure up to a charge density of 1.0 to 1.5 g/cc without the addition of binders and/or solvents, and shaped elastically to plastically under uniform or practically and/or gradually varying compression.

Due to the use of the funnel according to the invention, the propellent powder bodies cannot deposit any graphite during the pouring and compression on the orifice of the case, which would lead to a reduction of the friction forces on the inner wall of the case. Due to the reduction of the friction at the orifice of the case, the projectile, joined with the propellent case by crimping, has different extraction resistances which results in interior-ballistic changes and reduces the feeding reliability of the cartridges.

In accordance with the invention, a propellent charge is provided which comprises a cartridge case which has a base at one end and an orifice or opening at its opposite end. A propellent charge is drilled into the case and is made up of a plurality of powder bodies which may be tubular, spherical or strip shaped bodies which are pressed in the case without the addition of solvents or binders and substantially to plasticity under a compression pressure which varies from the base to the orifice and up to a charge density of from 1.0 to 1.5 g/cc.

In accordance with the method of the invention, the individual powder bodies are filled into the propellent cartridge case and they are compressed in the case by the application of an external pressure without using the binder or solvents so that the charge density varies throughout the length of the cartridge. This variation for example produces an increase of charge densities from the base to the orifice. This increase in density may change in zones for example a lowermost zone, an intermediate zone and an uppermost zone in the cartridge case. The filling is effected through a funnel using a mandrel arranged in a press die which is centered over a panel which widens upwardly from the base toward the orifice. It is at the center of charge.

Accordingly, it is an object of the invention to provide an improved propellent charge which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
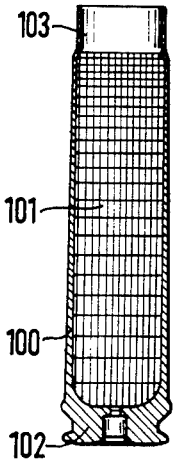
FIG. 2 is an axial sectional view of a propellent charge constructed in accordance with the invention.
Figure 3:
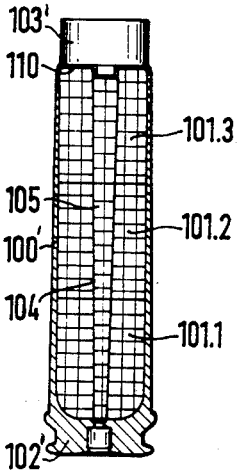
FIG. 3 is a view similar to FIG. 2 of another embodiment of the invention.

Referring to the drawings in particular the invention embodied therein, comprises a propellent charge as shown in FIG. 2, which includes a cartridge case 100 having a base 102 at one end and an opposite end with an orifice 103. The propellent charge 101 in the form propellent powder fills the case 100 and is made up of a plurality of powder bodies without solvents and binders which are compressed in the case substantially to plasticity under a compression pressure which varies from the base 102 to the orifice 103 and which will have a charge density of 1.0 to 1.5 g/cc. In the embodiment of the FIG. 2, the density is increased from base 102 to the orifice 103. In the embodiment of FIG. 3, the individual charge powders are compressed differently in a lowermost section 101.1, an intermediate section 101.2 and an upper section 101.3. The compression of the individual sections may be at the same pressure or a varying pressure within each section as well as between the sections.

EXAMPLE 1

Into a propellent case with a volume $V_H$ of 75 cc have been filled 70 g of a 19-hole propellent powder as a loose powder charge. The 19-hole propellent powder has the average geometric dimensions:

| | |
|---|---|
| initial inside diameter | $\phi$ 1A = 130 mym |
| outside diameter of propellent powder grain | $\phi$ TLP = 3.46 mm |
| propellent powder cylinder length | L TLP = 4.09 mm |

With a density of rho=1.608 g/cc, we obtain a number of propellent powders of Q=1.163. The entire surface of the propellent charge is $O_A$=1099 cm2 and is divided into an outer surface of Oa=730 cm2 and an inner surface of Oi=369 cm2. The surface is composed of the cylinder jacket, the end faces, and the surface of the bores in the propellent powder bodies.

Figure 1:
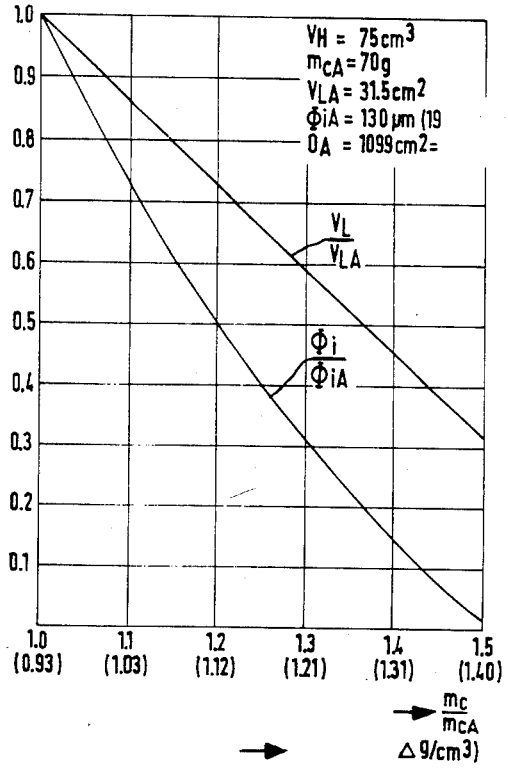
FIG. 1 is a diagram showing the sequence of functions of an increase in the charge mass with certain parameters.

In an increase of the charge mass by the method of the invention, the inside width of the inner channels will decrease, which will result in a decrease of the inner surface. It is not possible to determine a limit value for the required inside diameter $\phi$i of the inner channels as a function of an increase of the charge mass at which the initial melting surface $O_A$ of the propellent charge remains constant, despite the increase of the charge mass. Such a course for the treated embodiment is shown in FIG. 1. Also entered is the decrease of the free air volume resulting from the increase of the charge composition with $V_L/V_{IA}$ in the cartridge case, where $V_L$=the respective vacuum volume with filling and $V_{IA}$=the initial volume of air in the propellent case with a charge of 70 g. It can be readily seen from the diagram that the range of the charge density preferably given for the process between 1.1 and 1.3 g/cc for the selected embodiment indicates values for the inside width of the inner channel which are still technically feasible. On the other hand, the propellent case then still has a considerable vacuum, so that priming of the propellent charge is readily possible.

EXAMPLE 2

A 19-hole powder produced in known manner with a hole diameter of 0.15 mm and the composition:

73% by weight nitrocellulose
20% by weight diglycol dinitrate
5% by weight nitroquanadin
1% by weight methyl-diphenyl urea
1% by weight sodium sulfate on the surface of which was applied 1% dioctyl phthalate in an after treatment and whose individual grains have an outside diameter of 4.0 mm with a length of 4 mm is filled into propellent cases of 30 mm×113 DEFA. Prior to the filling, a mandrel was placed on the percussion cap, and then the powder was poured in. Subsequently the powder was compressed with a hand press and a press die into a hollow cylinder form (cylinder diameter=diameter of mandrel). After the compression, the mandrel was removed and powder was poured into the remaining hollow space. Altogether 62 g powder were pressed into the individual propellent cases. Subsequently practice projectiles with 245 g mass were inserted and crimped. In a 30 mm gas pressure meter, the maximum pressures P-max were determined in bar, and the muzzle velocities VE in m/s at the temperature of −40° C.+21° C. and +50° C. With the same maximum pressure we obtained the following velocity increase, compared to the values for the original propellent charge:

| T | DELTA V |
|---|---|
| −40° C. | +65 m/s |
| +21° C. | +63 m/s |
| +50° C. | +69 m/s |

T stands for temperature and DELTA V for the increased performance by the increase of the projectile velocity.

With the same propellent powder and a propellent case of 27 mm×145 we obtained the following improvement in a charge increase by 13.5 g:

| T | DELTA V |
|---|---|
| −40° C. | +30 m/s |
| −25° C. | +37 m/s |
| +21° C. | +51 m/s |
| +50° C. | +55 m/s |

Tests with propellent charge samples slightly modified in geometry and surface treatment yielded a velocity increase between 50 and 111 m/s with the process of the invention, compared to cartridge of 25 mm×137 APDS and 105 mm×617 APDS. This means that the process of the invention can also be used in a wide caliber range and in different types of projectiles.

Figure 4:
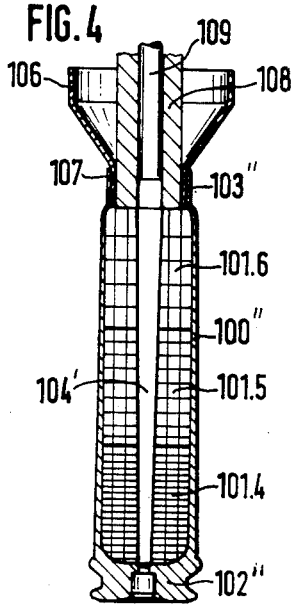
FIG. 4 is a view showing the filling of the cartridge case to achieve the construction which is similar to that shown in FIG. 3, but where the compression of the propellent powder is effected in three stages using a central mandrel and filling funnel.

The schematic representation of the propellent cases with pressed-in propellent powder according to FIGS. 2 to 4 shows in FIG. 2 a propellent case 100 with a propellent powder 101, which is compressed gradually from base 102 to orifice 103 of the case. In the represented example, the charge density increases up to case orifice 103.

FIG. 3 shows propellent case 100' with base 102' and orifice 103'. The propellent powder has been filled here in three partial amounts 101.1, 101.2 and 101.3 into propellent case 100' and has been compressed in sections with the same pressure.

Starting from base 102', there is a conically widening channel 104 in the longitudinal axis of propellent case 100' extending to orifice 103' which is filled with propellent powder 105. The upper free pressed rim of the upper partial amount of the propellent powder is stabilized against crumbling off and/or warping of the compressed level by a plastic-elastic cover 110, which burns without leaving a residue.

FIG. 4 shows again a propellent case 100" with base 102" and orifice 103". Propellent powder has been pressed with different pressures into propellent case 100". We obtain thus for the bottom partial amount 101.4 the greatest charge density, which decreases over partial amount 101.5 to partial amount 101.6. In this example, the greatest charge density is at base 102". In the longitudinal axis of propellent case 100", channel 104 has been created with the greatest conical widening toward orifice 103". The propellent powder is poured into the propellent case over a funnel 106 whose filling tube 107 bears directly on the inner wall of orifice 103". 108 denotes the press die and 109 a mandrel for protecting the priming element in base 102".

While specific embodiments of the invention have been shown and described in detail to illustrate the application of the principles of the invention, it will be understood that the invention may be embodied otherwise without departing from such principles.

What is claimed is:

1. A propellant charge comprising a cartridge case defining a space and having a base at one end and an orifice at its opposite end, and a propellant charge filling said case under compression and consisting only of a plurality of powder bodies without solvents and binders, compressed in said case elastically to plasticity under a compression pressure to a charged density of from 1.0 to 1.5 g/cc, said powder bodies all being substantially identical multiple hole powder parts with channels and a melting surface which is reduced by the compression.

2. A propellent charge according to claim 1, wherein the powder bodies are compressed to a compression pressure which varies in steps between said base and said orifice.

3. A propellent charge according to claim 2, wherein the powder bodies are compressed in independent sections at different selected compression pressures.

4. A propellant charge according to claim 1, including a priming element in said base and wherein the compressed powder bodies are formed so as to leave a central channel extending from said primer element to said orifice.

5. A propellent charge according to claim 4, including propellent powder in said channel with a rim overlying the propellent powder within said channel, made of plastic material which burns without leaving a residue.

6. A propellant charge comprising a cartridge case defining a space and having a base at one end and an orifice at its opposite end, and a propellant charge filling said case under compression and consisting only of a plurality of powder bodies without solvents and binders, compressed in said case elastically to plasticity under a compression pressure to a charged density of from 1.0 to 1.5 g/cc, said powder bodies all being substantially identical tubular powder parts with channels and a melting surface which is reduced by the compression.

7. A propellant charge according to claim 6, including a priming element in said base and wherein the compressed powder bodies are formed so as to leave a central channel extending from said priming element to said orifice.

8. A propellent charge according to claim 7, including propellent powder in said channel with a rim overlying the propellent powder within said channel, made of plastic material which burns without leaving a residue.

9. A method of producing a propellant charge using a case defining a space and having a base on one end and an orifice at its opposite end, comprising:

positioning a funnel having a filling nipple engaged against an inner wall of said case defining said orifice;

filling only powder bodies into said case through said funnel, said powder bodies being without solvent and without binders and consisting only of powder bodies having channels therein; and compressing said powder bodies under sufficient pressure to form a charge density of from 1.0 to 1.5 g/cc, said powder bodies being compressed elastically to plasticity to reduce said channels and thus reduce a melting surface of said powder bodies.

10. A method according to claim 9, including stabilizing said powder bodies against crumbling and warping due to said compressing step by applying a covering of plastically adaptable material which combusts without residue.

11. A method according to claim 9, including utilizing a press having a central opening, in said filler nipple to compress the powder bodies, and extending a mandrel through said center opening to form a channel in the propellent charge in said case formed by said powder bodies, from said orifice to a center of the base, the center of the base containing a primer for igniting the propellent charge, and filling the channel with additional propellent charge.

12. A method according to claim 11, including applying a rim of plastically adaptable material over the propellent charge of said compressed bodies and in said channel, the plastically adaptable material being combustable without residue.

* * * * *